US006463161B2

(12) United States Patent
Klein et al.

(10) Patent No.: US 6,463,161 B2
(45) Date of Patent: Oct. 8, 2002

(54) ELECTROACOUSTIC TRANSDUCER HAVING CONTACT HOLDING MEANS FOR SPRING CONTACTS FOR THE ELECTRICAL CONNECTION OF THE TRANSDUCER

(75) Inventors: Erich Klein, Himberg; Heinz Nierlich; Thomas Pauser, both of Vienna, all of (AT)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 09/982,261

(22) Filed: Oct. 17, 2001

(65) Prior Publication Data

US 2002/0071589 A1 Jun. 13, 2002

(30) Foreign Application Priority Data

Oct. 17, 2000 (EP) ..... 00890317

(51) Int. Cl.[7] ..... H04R 1/00

(52) U.S. Cl. ..... 381/409; 381/396; 381/412; 439/733.1; 439/862

(58) Field of Search ..... 381/409, 410, 381/412, 420, 400, 386, 396, 394, FOR 154, FOR 159; 439/733.1, 862; 379/433.05, 433.02, 438

(56) References Cited

U.S. PATENT DOCUMENTS

| | | | | | |
|---|---|---|---|---|---|
| 4,590,337 | A | * | 5/1986 | Engelmore | 379/438 |
| 6,038,327 | A | * | 3/2000 | Bleim et al. | 381/386 |
| 6,072,886 | A | * | 6/2000 | Frasl et al. | 381/409 |
| 6,370,257 | B1 | * | 4/2002 | Bleim et al. | 381/409 |

FOREIGN PATENT DOCUMENTS

| | | | |
|---|---|---|---|
| WO | WO9838832 | 9/1998 | H04R/1/06 |

* cited by examiner

*Primary Examiner*—Huyen Le
(74) *Attorney, Agent, or Firm*—Edward W. Goodman

(57) ABSTRACT

In an electroacoustic transducer (1) having a hollow cylindrical magnet system (8) and a contact holding assembly (22), retained in an inner zone (21), for holding spring contacts (37, 38), the contact holding assembly (22) includes two preferably identical contact holding elements (23, 24) which adjoin one another along two identically shaped bounding surfaces (26, 28), and each contact holding element (23, 24) has a holding chamber (29, 30) which opens towards its bounding surface (26, 28), each holding chamber (29, 30) accommodating a spring contact (37, 38) inserted into the holding chamber (29, 30) from the side of the bounding surface (26, 28).

8 Claims, 1 Drawing Sheet

ELECTROACOUSTIC TRANSDUCER HAVING CONTACT HOLDING MEANS FOR SPRING CONTACTS FOR THE ELECTRICAL CONNECTION OF THE TRANSDUCER

BACKGROUND OF THE INVENTION

1. Field of the Invention

The invention relates to an electroacoustic transducer having a substantially hollow symmetrical magnet system and having contact holding means which are retained in the inner zone of the magnet system and which hold spring contacts for the electrical connection of the transducer.

2. Description of the Related Art

Such a transducer of the type defined in the opening paragraph is known, for example, from International Patent Application No. WO 98/38832 A1 corresponding to U.S. Pat. No. 6,072,886. In the known transducer, the contact holding means is formed by a pot-shaped contact holder having a bottom wall and a hollow cylindrical circumferential wall which is integrally connected to the bottom wall in the peripheral area of the bottom wall. Two substantially U-shaped spring contacts are mounted in the pot-shaped contact holder, one limb of each of said spring contacts extending parallel to the bottom wall and having a terminal lug which extends through the bottom wall of the contact holder. In the known transducer, the two spring contacts must be inserted into the pot-shaped contact holder in the direction of the transducer axis and must be retained in the pot-shaped contact holder by separate means, for example, with the aid of an interlocking connection or an adhesive joint. The construction known from the known transducer has proven itself millions of times in practice.

The known construction described hereinbefore is subject to limitations in that with the trend towards further miniaturization of such a transducer, the known construction leads to problems because, in the case of further miniaturization, the wall thicknesses of the bottom wall and the circumferential wall of the pot-shaped contact holder become so small that problems may arise with the strength of the pot-shaped contact holder, and production problems during the production of the plastic pot-shaped contact holder, as well as problems with the assembly and fastening of the spring contacts in the pot-shaped contact holder.

SUMMARY OF THE INVENTION

It is an object of the invention to provide a solution for a transducer of the type defined in the opening paragraph which enables a further miniaturization of such a transducer to be achieved and, in spite of the further miniaturization, guarantees a stable construction in the area of the contact holding means.

In order to achieve the aforementioned object, characteristic features in accordance with the invention are provided, in a transducer in accordance with the invention, in such a manner that a transducer in accordance with the invention can be characterized in the manner defined hereinafter, namely:

An electroacoustic transducer having a magnet system which is substantially centro-symmetrical with respect to a transducer axis and which is substantially hollow cylindrical and includes an annular magnet arranged parallel to a plane which extends transversely to the transducer axis, which magnet system surrounds an inner zone, and having contact holding means which, at least for the greater part, is accommodated in the inner zone and is retained in the inner zone, and having two spring contacts for the electrical connection of the transducer, the spring contacts being retained with the aid of the contact holding means and each being formed with at least one bend, wherein the contact holding means has two contact holding elements adjoining one another along two identically shaped bounding surfaces extending transversely to the plane, and wherein each contact holding element has a holding chamber opening towards its bounding surface, the holding chamber of each contact holding element accommodating one of said spring contacts inserted into the holding chamber from the side of the bounding surface.

As a result of the provision of the measures in accordance with the invention, it is achieved that, even in the case of a very small size, a construction of the contact holding means having a high mechanical stability is obtained in a constructionally very simple and cheap manner. Furthermore, this has the advantage that, apart from the contact holding elements, no further additional means are required in order to retain the spring contacts because the spring contacts are simple retained by interlocking with the contact holding elements.

A transducer in accordance with the invention may include not only two contact holding elements and two spring contacts, but it is likewise possible to provide three or four contact holding elements and, consequently, three or four spring contacts. In a transducer in accordance with the invention, the bounding surfaces of the contact holding elements, along which the contact holding elements adjoin one another, may have a shape which is inclined with respect to the plane of the annular magnet, this shape corresponding to a flat, of alternatively a curved, bounding surface. However, it has proven to be very advantageous when the preferably two contact holding elements adjoin one another along two bounding surfaces which extend parallel to the transducer axis and which preferably extend through the transducer axis. This is advantageous in view a construction of the contact holding elements which is as simple as possible.

It has proven to be particularly advantageous when the two contact holding elements in a transducer in accordance with the invention are wholly identical. This is particularly advantageous in view of a cost-effective production and, above all, in view of a simple automated production process.

It has further proven to be advantageous when each contact holding element has a raised portion and a recess in the area of its bounding surface because these means ensure a simple positioning of the contact holding elements with respect to one another.

In this connection, it has further proven to be very advantageous when the raised portion of one contact holding element is used for securing a portion of the spring contact in the other contact holding element. In addition to the reliable positioning of the spring contact this also has the advantage that, in the case that a spring contact has not been inserted deep enough into the holding chamber.

Tests have proven that it is very advantageous when each spring contact has a first portion and a second portion as well as a U-shaped third portion, because such a construction ensures a particularly reliable retention and a particularly reliable contacting.

In a transducer in accordance with the invention, two contact holding elements, combined to form a contact holding means, may form a contact holding means of, for example, square cross-sectional shape in a direction transverse to the transducer axis. However, it has proven to be particularly advantageous when two contact holding elements together form a substantially cylindrical contact holding means, which is pressed into the inner zone of the magnet system, because this ensures a particularly reliable retention and an exact positioning of the contact holding means and, consequently, of the spring contacts.

The above-mentioned as well as further aspects of the invention will become apparent from the embodiment described hereinafter by way of example and will be elucidated with reference to this example.

BRIEF DESCRIPTION OF THE DRAWINGS

The invention will now be described in more detail with reference to the drawing, which shows an embodiment given by way of example but to which the invention is not limited, in which.

DESCRIPTION OF THE PREFERRED EMBODIMENTS

Figure 1:
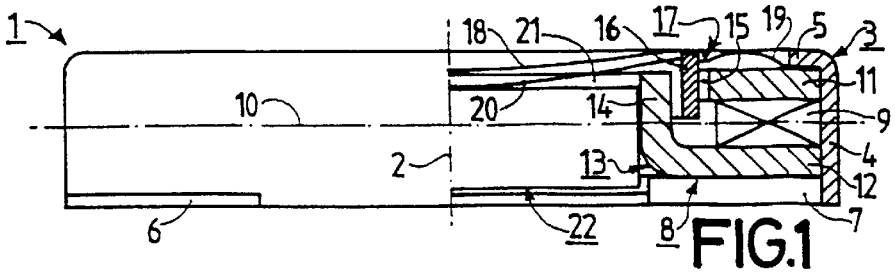
FIG. 1 is a side view, partly in a sectional view, of an electroacoustic transducer embodying the invention, which includes contact holding means shown symbolically as a block in FIG. 1.

FIG. 1 shows an electrodynamic electroacoustic transducer 1 having a transducer axis 2. To accommodate and hold the individual parts of the transducer 1, the latter comprises a plastic housing 3. The housing 3 essentially comprises a hollow cylindrical circumferential wall 4, which changes into a narrow annular bounding wall 5 at the top and which has three mounting projections at the bottom, which are spaced at equal angles from one another and of which only two mounting projections 6 and 7 are shown in FIG. 1. Prior to assembly of the transducer 1, the mounting projections 6 and 7 project from the circumferential wall 4 in axial directions and, after all the parts of the transducer 1 have been mounted in the housing 3, said projections are bent using of an ultrasonic process.

The transducer 1 has a substantially hollow cylindrical magnet system 8, which is substantially centro-symmetrical with respect to he transducer axis 2 and whose construction is apparent from FIG. 1. The magnet system 8 comprises an annular magnet 9, which is arranged parallel to a plane 10 which extends transversely, in the present case, exactly perpendicularly to the transducer axis 2 and which is adjoined by an annular cover disc 11 at its upper side and by an annular core disc 12 of a yoke 13 at its lower side. The yoke 13 comprises the annular core disc 12 and, in addition, a hollow cylindrical yoke portion 14, an end remote from the core disc 12 extending into the area of the cover disc 11, namely, in such a manner that an annular air gap 15 is formed between the cover disc 11 and the yoke portion 14.

Figure 2:
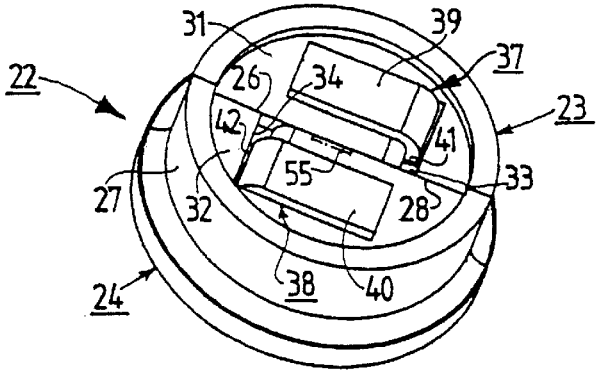
FIG. 2 is an oblique plan view showing the contact holding means together with spring contacts of the transducer shown in FIG. 1.

A voice coil 16 wound from coil wire is arranged in the air gap 15 and is shown only diagrammatically in FIG. 2 because such a construction of a coil wound from coil wire is generally known. In known manner, the voice coil 16 is secured to a diaphragm 17 by means of an adhesive joint, this diaphragm performing excursions in the direction of the transducer axis 2. The diaphragm 17 comprises a curved central portion 18 and an annular peripheral portion 19 which is connected to the cover disc 11 by an adhesive with its edge zone, which lies between the narrow annular bounding wall 5 of the housing 3 and the cover disc 11.

In the transducer 1 shown in FIG. 1, the cover disc 11, the annular magnet 9, the core disc 12 of the yoke 13 and the diaphragm 17 all have the same outer diameter, which is adapted accurately to the inner diameter of the circumferential wall 4 of the housing 3 in such a manner that the core disc 12 of the yoke 13, the annular magnet 9 as well as the cover disc 11 and, consequently, also the diaphragm 17 are positioned exactly with respect to the transducer axis 2 by means of the circumferential wall 4 of the housing 3. This also results in an exact positioning of the voice coil 16 in the air gap 15, so that always an unimpeded vibration of the voice coil 16 is guaranteed. It is to be noted that the voice coil 16, made of coil wire, has two coil leads, of which only one lead 20 is shown in FIG. 1.

Figure 3:
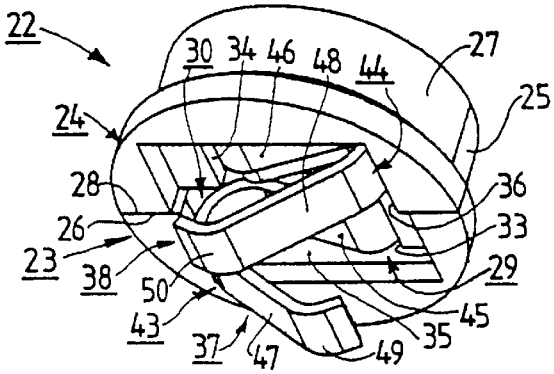
FIG. 3 is an oblique underneath view showing the contact holding means together with spring contacts of the transducer shown in FIG. 1.
Figure 4:
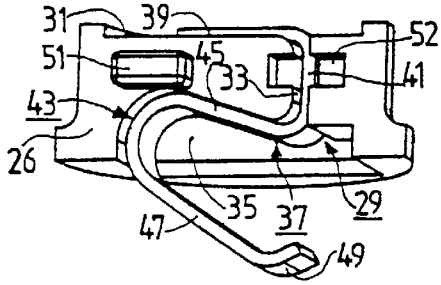
FIG. 4 is an oblique side view from underneath showing a contact holding element together with a spring contact of the contact holding means shown in FIGS. 2 and 3.
Figure 5:
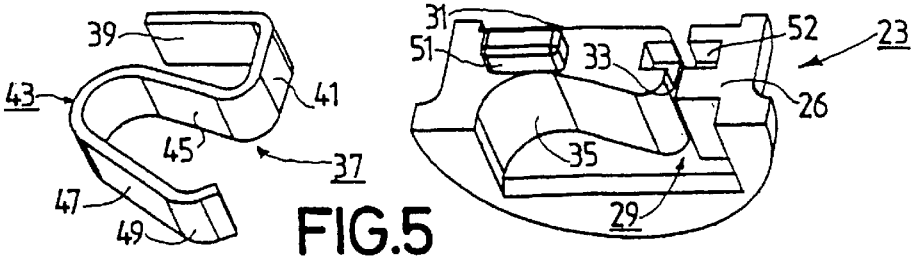
FIG. 5 shows, in a manner similar to FIG. 4, the contact holding element together with a spring contact, but in a non-assembled condition.

In the transducer 1, the hollow cylindrical magnet system 8 surrounds an inner zone 21, as can be seen in FIG. 1. The greater part of contact holding means 22 is accommodated and retained in this inner zone 21, the contact holding means 22 being shown only diagrammatically as a block in FIG. 1. The contact holding means 22 is shown wholly and in detail in FIGS. 2 and 3. FIGS. 4 and 5 each show only one half of the contact holding means 22, namely, a contact holding element together with the spring contact it holds.

In the transducer 1 shown in FIG. 1, the contact holding means 22 includes two contact holding elements 23 and 24. Each of the two contact holding elements 23 and 24 has a shape which is substantially semicylindrical. Consequently, the first contact holding element 23 is bounded by a semicylindrical circumferential surface 25 and flat bounding surface 26, i.e., by a bounding plane 26 which extends through the transducer axis 2. Likewise, the second contact holding element is bounded by a semicylindrical circumferential surface 27 and flat bounding surface 28, i.e., by a bounding plane 28 which extends through the transducer axis 2. The two contact holding elements 23 and 24 adjoin one another along the two identically shaped flat bounding surfaces 26 and 28, which extend transversely, i.e., perpendicularly, to the plane 10. Thus, the two contact holding elements 23 and 24 together form a cylindrical contact holding means 22. This cylindrical contact holding means 22 is pressed into the inner zone of the magnet system 8, a press-fit being formed between the semicylindrical circumferential surfaces 25 and 27 of the two contact holding elements 23 and 24 and the inner surface of the hollow cylindrical yoke portion 14.

Each of the two contact holding elements 23 and 24 has a holding chamber, 29 and 30, respectively, which opens towards its respective bounding surface 26 or 28. Each of the two holding chambers 29 and 30 consists of three portions in total, namely, a semicircular recess 31 or 32 in the area of each of the two contact holding elements 23 and 24 which faces the central portion 18 of the diaphragm 17, a respective slot 33 or 34 in each respective contact holding element 23 or 24, which slots extend parallel to the transducer axis 2, and a respective recess 35 or 36, formed in each of the contact holding elements 23 and 24 in an area remote from the central portion 18 of the diaphragm 17.

The holding chamber 29 or 30 of each of the contact holding elements 23 and 24 accommodates a respective spring contact 37 or 38 inserted into the respective holding chamber 29 or 30 from the side of the respective flat bounding surface 26 or 28.

Each of the two spring contacts 37 and 38 has a first portion 39 or 40, respectively, which extends substantially parallel to the plane 10. Furthermore, each spring contact 37 or 38 has a second portion 41 or 42, respectively, which is bent with respect to the respective first portion 39 or 40 and which extends transversely, in the present case perpendicularly, to the plane 10. Each of the two spring contacts 37 and 38 further has a U-shaped third portion 43 or 44, respectively, this third portion 43 or 44 projecting from the respective second portion 41 or 42, and having a first limb 45 or 46, respectively, which is bent with respect to the respective second portion 41 or 42, and a second limb 47 or 48, respectively, which is bent with respect to the respective first limb 45 or 46. The free end 49 or 50 of the second limb 47 or 48, respectively, is adapted to engage with a mating contact, for which reason the free end has been given a bent shape.

Each of the two contact holding elements 23 and 24 has a projection 51 on its flat bounding surface 26 or 28, respectively, and has a recess 52 which terminates in the flat bounding surface 26 or 28, respectively. FIGS. 4 and 5 show only the projection 51 and the recess 52 of the first contact holding element 23. The projection 51 and the recess 52 of the second contact holding element 24 are not visible in the Figures. The projection 51 of each contact holding element 23 or 24 engages the recess 52 in the other contact holding element 24 or 23, respectively. Since the recess 52 is situated in the area of the slot 33 or 34 of the holding chamber 29 or 30, respectively, of each contact holding element 23 or 24, respectively, it is achieved that the projection 51 of each contact holding element 23 or 24, engages the recess 52, and serves to retain a portion of the respective spring contact 38 or 37, this portion engaging in the other contact holding element 24 or 23, respectively, because the size of the projection 51 has been selected in an appropriate manner, i.e., because the projection 51 has been given a corresponding height.

Due to the above described construction of the contact holding means 22, which is made up of two contact holding elements 23 and 24, a mechanically robust construction is achieved even in the case that the contact holding means 22 is very small, which, in addition, has the advantage that the spring contacts 37 and 38 are retained in a particularly simple and reliable manner without any additional means being required, which is because the spring contacts 37 and 38 are positioned and retained in their operating positions with the aid of the contact holding elements 23 and 24 in a positive manner.

The solution described above has the great advantage that, even in the case of a highly miniaturized construction of such an electroacoustic transducer 1, the contact holding means 22 of the miniaturized transducer 1 is mechanically stable and robust. For example, in the course of development activities conducted by Applicant, an electroacoustic transducer 1 in accordance with FIG. 1 was realized, in which the outer diameter of the transducer housing 3 was approximately 6.0 mm, as a result, the contact holding means 22 had to be realized with a correspondingly small diameter. In this respect, a transducer 1 and its holding means 22 constructed in accordance with the invention has proven to be particularly advantageous.

The invention is not limited to the embodiment described hereinbefore. If required, a transducer in accordance with the invention may alternatively include three or four contact holding elements, which each carries a spring contact and which are joined to form contact holding means accommodated and retained in the inner area of the hollow cylindrical magnet system. Furthermore, it is to be noted that alternative shapes for the spring contacts are possible. The spring contacts may, for example, be simply U-shaped.

In addition, it is to be noted that in an embodiment of an electroacoustic transducer 1 as described with reference to FIGS. 1 to 5, it has also proven to be very advantageous when at least one of the two contact holding elements 23 and 24 has a recess 55 in its bounding surface 26 or 27, this recess extending parallel to the transducer axis 2, as is shown in dash-dot lines in FIG. 2. Such a recess may have a depth between 0.1 mm and 0.3 mm and a width between 0.3 mm and 1.5 mm. With such a dimensioning, such a recess 55, in a bounding surface 28 together with the other bounding surface 26, forms an axial channel, which constitutes an acoustic friction. If desired, the acoustic behavior of the transducer can be influenced as desired with the aid of such an acoustic friction.

What is claimed is:

1. An electroacoustic transducer comprising:

a magnet system substantially centro-symmetrical with respect to a transducer axis, said magnet system being substantially hollow cylindrical and including an annular magnet arranged parallel to a plane extending transversely to the transducer axis, said magnet system surrounding an inner zone;

contact holding means being, at least for the greater part, accommodated in the inner zone and being retained in the inner zone; and two spring contacts for establishing an electrical connection of the transducer, said spring contacts being retained by the contact holding means, and being formed with at least one bend, wherein the contact holding means comprises two contact holding elements adjoining one another long two identically shaded bounding surfaces extending transversely to the plane, each of said two contact holding elements having a holding chamber opening towards the bounding surface thereof, the holding chamber of each contact holding element accommodating a respective one of the two spring contacts inserted into the holding chamber from the side of the bounding surface.

2. The transducer as claimed in claim 1, wherein the two contact holding elements adjoin one another along two bounding planes extending parallel to the transducer axis.

3. The transducer as claimed in claim 2, wherein the two contact holding elements adjoin one another along the two bounding surfaces extending through the transducer axis.

4. The transducer as claimed in claim 3, wehrein the two contact holding elements are wholly identical.

5. The transducer as claimed in claim 1, wherein each of the contact holding elements has a raised portion in the area of the bounding surface, said raised portion projecting from the bounding surface, and a recess terminating in the bounding surface, the raised portion of each contact holding element engaging the recess of the other contact holding element.

6. The transducer as claimed in claim 5, wherein the raised portion of each contact holding element secures a portion of the spring contact held in the other contact holding element.

7. The transducer as claimed in claim 1, wherein each spring contact has a first portion extending substantially parallel to the plane, a second portion bent with respect to the first portion and extending transversely to the plane, and a U-shaped third portion projecting from the second portion, said third portion having a first limb bent with respect to the second portion, a second limb bent with respect to the respective first limb, and a free end for engaging with a mating contact.

8. The transducer as claimed in claim 1, wherein the two contact holding elements together form the contact holding means which is substantially cylindrical, said contact holding means being pressed into the inner zone of the magnet system.

* * * * *